United States Patent [19]

Wasson

[11] 4,032,375

[45] June 28, 1977

[54] BLASTING COMPOSITION CONTAINING CALCIUM NITRATE AND SULFUR

[75] Inventor: Daniel A. Wasson, Salt Lake City, Utah

[73] Assignee: Ireco Chemicals, Salt Lake City, Utah

[22] Filed: Jan. 20, 1975

[21] Appl. No.: 542,280

[52] U.S. Cl. ..... 149/41; 149/2; 149/43; 149/44; 149/60; 149/61

[51] Int. Cl.[2] ..... C06B 33/14

[58] Field of Search ..... 149/41, 43, 61, 60, 149/72, 73

[56] References Cited

UNITED STATES PATENTS

| | | | |
|---|---|---|---|
| 3,653,996 | 4/1972 | Edwards | 149/61 X |
| 3,713,917 | 1/1973 | Cook et al. | 149/61 X |
| 3,886,010 | 5/1975 | Thornley et al. | 149/73 X |

*Primary Examiner*—Stephen J. Lechert, Jr.
*Attorney, Agent, or Firm*—Robert A. Bingham

[57] ABSTRACT

The present invention relates to improved explosives or blasting compositions of the aqueous gel or slurry type. In general, it concerns such blasting compositions employing a combination of calcium nitrate as oxidizer salt and sulfur as fuel. This combination effectively sensitizes the composition and renders its sensitivity relatively less dependent upon temperatures. In addition, this combination imparts desirable physical properties to the composition.

14 Claims, No Drawings

BLASTING COMPOSITION CONTAINING CALCIUM NITRATE AND SULFUR

BACKGROUND OF THE INVENTION

Explosives or blasting compositions of the aqueous gel or slurry type, commonly referred to as slurry explosives or blasting agents, have achieved wide acceptance as commercial blasting agents owing to their low cost, safety and inherent water-resistance. Aqueous slurry blasting agents, containing a continuous liquid phase and comprising generally an inorganic oxidizing salt (usually predominantly ammonium nitrate (AN)), a thickening agent for the liquid phase in which some or all of the oxidizing salt is dissolved, a fuel and/or sensitizer and, optionally, other ingredients such as gassing and cross-linking agents, have been very successful even in water-containing boreholes.

In order to insure adequate sensitivity of slurry blasting compositions (without incorporating hazardous self-explosive sensitizers such as TNT and PETN) non-explosive sensitizing materials, primarily finely divided aluminum particles such as paint-grade aluminum, are generally employed. For example, U.S. Pat. No. 3,367,805 discloses that the use of small amounts, 5% or less, of very finely divided or paint-grade-type aluminum containing a lyophobic coating such as of stearic acid provides significant sensitization to a slurry blasting composition. The sensitivity of slurry blasting compositions is commonly measured by its critical diameter (the smallest diameter in which a cylindrical charge of explosive will effectively and completely propagate a detonation wave and thus in which the explosive charge will successfully detonate). Even small amounts of paint-grade aluminum (1% by weight or less) have been found to reduce significantly the critical diameter of a given composition at a given temperature and thus to increase significantly its sensitivity.

The use of paint-grade aluminum as a sensitizer is practicably limited, however, due to its relatively high cost as compared with the other ingredients of the explosive. Thus many attempts have been made to find substitute, less expensive sensitizers. U.S. Pat. No. Re27,095 teaches that a combination of elemental sulfur (S) and sodium nitrate (SN) acts as a sensitizer in an aqueous or slurry blasting composition. More specifically, this patent teaches that a slurry blasting composition containing from about 5 to 25% by weight of an aqueous liquid, 40 to 70% of ammonium nitrate (AN), a combination of 2 to 25% SN and 1 to 8% S and additional fuel to tend to balance the excess oxygen of the oxidizer salts is significantly sensitized by the SN/S combination. This sensitization is attributed to the reaction between SN and S to form sodium sulfate, nitrogen and oxygen. This reaction proceeds more readily with SN than with AN; thus the sensitizing effect of SN/S is not observed with AN/S. This patent also teaches that SN/S provides goods sensitivity at low temperatures but does not render the composition overly sensitive and thus hazardous at higher temperatures, e.g., 5° and 35° C, respectively.

U.S. Pat. No. 3,282,752 also teaches that SN/S provides sensitization. However, this patent discloses that good sensitizing results are obtained by using the SN/S in a ratio substantially lower than stoichiometrically required for their complete reaction. U.S. Pat. No. Re27,095 discloses a preferred SN:S ratio of about 5:1 whereas this patent discloses an optimum ratio of 1.2:1. U.S. Pat. No. 3,282,752 teaches that at the lower SN:S ratios (3:1 or below) sensitization by SN/S becomes even less temperature dependent.

U.S. Pat. No. 3,473,983 also discloses the sensitizing effect of SN/S. This patent teaches, specifically, that the use of relatively high proportions of SN (generally equaling or or exceeding the proportions of AN) in combination with corresponding proportions of S sufficient to bring the SN:S ratio within limits of 4:1 to 9:1 provides a sensitive, effective blasting composition even though SN was not theretofore considered as effective an oxidizer as AN in such high amounts. Thus, an effective blasting composition is disclosed containing SN/S sensitization and SN per se in amounts up to 45% by weight of the total composition.

Although S is found to have particular sensitizing effects in combination with SN slurry blasting compositions, it has also been commonly employed as a fuel per se, either with or without SN. For example, U.S. Pat. No. 3,713,917 discloses that S can be used as an effective, solid particulate fuel in a slurry blasting composition along with and in the same manner as other fuels such as aluminum and carbonaceous materials such as gilsonite or coal. In addition, this patent discloses that the use of relatively high proportions of calcium nitrate (CN) (which theretofore had been generally regarded as a less effective oxidizer than AN in explosive compositions) provides, in combination with other specified ingredients, a highly effective and sensitive explosive composition which can be made detonable in relatively small diameters (about 3 inches or less) and one which has good water-resistance and stability characteristics. Thus, this patent suggests the possibility of a combination of relatively high amounts of CN (20% or more) as an oxidizer and S, in significant amounts, as a fuel. However, no specific mention of such combination is made nor do any of the examples disclose such combination. Thus although the prior art may suggest the possible combination of CN and S in a composition, it does not specifically disclose such combination or provide any elaboration as to the amounts and relative proportions of CN and S to be used such as are required for the present invention.

The present invention is based on the discovery that the combination of specific proportions and amounts of CN and S in an aqueous blasting composition acts as a highly effective sensitizer. In fact, although similar thereto, CN/S is surprisingly found to be a significantly better sensitizer than SN/S. And compositions containing CN/S are found to have significantly different properties than those containing SN/S.

One advantage of CN/S over SN/S is that CN/S provides a significantly higher level of sensitization than SN/S.

Another advantage of CN/S over SN/S is that CN/S sensitization is significantly and importantly less dependent upon temperature than even SN/S sensitization which, as explained above, was found to be relatively temperature independent. In particular, it is often desirable to have a composition which is sensitive and, therefore, capable of detonation in a small diameter (2 inches or less) at relatively low temperatures (5° C or lower) but yet at the same time be non-cap-sensitive at higher temperatures (20° C or higher) and thus which does not become overly sensitive at higher temperatures. It has been observed with SN/S-sensitized compositions, which are sufficiently sensitive for reliable detonation at 5° C, that they in turn may become cap-sensitive at 20° C or higher and thus may become for practicable purposes undesirably sensitive. For example, cap-sensitive explosives require much greater safety precautions for handling and transportation. In contrast, CN/S-sensitized compositions can readily be made to be sufficiently sensitive for reliable small diameter detonation at 5° C but still are non-cap-sensitive at 20° C or higher and to exhibit generally a markedly less dependence of sensitivity upon temperature.

Still another advantage of the present invention over SN/S sensitization is attributable to the use of high proportions of CN. As explained in U.S. Pat. Nos. 3,660,181 and 3,713,917, CN contains water of crystallization which is released upon dissolution of the salt into an aqueous fluid solvent but which is correspondingly taken from the solvent upon subsequent precipitation of part or all of the salt. Thus, compositions of the present invention can be prepared at elevated temperatures with no or a minimum of added water or other solvent since sufficient fluidity for homogeneous mixing purposes can be provided upon dissolution of the CN and release of its water of crystallization at the elevated temperature where its solubility is high. The newly formed slurry can then be pumped or transferred into a desired container while still fluid (its temperature being above the fudge point of the salt solution). Finally, after pumping and upon subsequent cooling of the composition to the ambient temperature, part or all of the CN in solution will precipitate or crystallize thereby taking back its previously released water of crystallization and thus rendering the composition less fluid and perhaps even relatively non-fluid or hard. The transformation of a relatively fluid composition into a relatively hard one is efficacious for two reasons: (a) it renders the composition more stable by preventing migration, segregation and/or coalescence of dispersed ingredients and by making the composition more water-resistant and (b) it renders the composition relatively incompressible and thus relatively pressure independent with regard to its detonability. The end result, hardness, is the important one and thus anhydrous CN could be used since the initial solution essentially does not distinguish between released water of crystallization and added water, and the anhydrous CN will take out water of crystallization upon precipitation. However, hydrated CN is more economically available.

Compositions of the type of the present invention generally contain finely dispersed gas bubbles which lower their density and which have been found to greatly increase their sensitivity. In compositions which are not hard, this dispersion of gas bubbles allows the composition to be compressible and thus at high pressures its density may increase to such an extent that it no longer remains sensitive to detonation. If CN is so used as described above, a composition can be made which is essentially incompressible due to its relative hardness even though it contains a fine dispersion of gas bubbles. Thus, the CN/S combination of the present invention not only provides better sensitization but also, in addition, imparts desirable physical characteristics to the composition due to the water of crystallization in CN.

SUMMARY

An aqueous blasting composition comprising inorganic oxidizer salt, partially or completely dissolved in an aqueous fluid phase; solid or liquid fuel or both; thickener; and, as a sensitizer, a combination in sensitizing proportions of CN as oxidizer salt and S as fuel is found to be highly effectively sensitized and to possess other desirable properties.

DESCRIPTION OF PREFERRED EMBODIMENTS

The aforementioned advantages and differences of CN/S-sensitization as compared with SN/S sensitization are observed to commence practicably, particularly with regard to sensitizing effect, with a minimum CN content of about 20% by weight based on the total composition (except where otherwise indicated, percentages of CN will hereafter be taken to exclude water of crystallization which, nevertheless, is normally associated with the CN, for example, in proportions of about 15% by weight for commercial grade CN) and with a sufficient amount preferably from about 5 to about 7% by weight of S. The hardness effect described above becomes pronounced with proportions of CN above 30% by weight. Preferably, S is present in a corresponding amount sufficient to provide a CN:S ratio of about 5.3:1, the stoichiometric ratio for the reaction of CN and S to form calcium sulfate, nitrogen, and oxygen, although S can be present in the amount of only about 3% or more and still provide for adequate sensitization. S in excess of the above optimum proportion does not significantly contribute to further sensitization and thus the excess amount acts simply as a fuel. The upper limits for both CN and S are not critical and are limited basically by practicability as necessary for an essentially oxygen-balanced explosive composition. S is normally not used in amounts greater than the optimum ratio.

Inclusive of the CN/S combination, the compositions of the present invention generally comprise inorganic oxidizer salt, liquid or solid fuel or both, water, thickening agent and, optionally, gassing and cross-linking agents.

The oxidizer salt or salts of which at least about 20% by weight of the total composition is CN are selected from the group consisting of ammonium and alkali metal nitrates and perchlorates and ammonium and alkaline earth metal nitrates and perchlorates. Examples of such salts are AN, SN, CN, potassium nitrate, ammonium perchlorate, calcium perchlorate, potassium perchlorate, etc. Preferably, the oxidizer salt comprises a combination of AN and CN in preferably about equal proportions. The total oxidizer salt employed is generally from about 50 to about 80% by weight of the total composition and preferably from about 60 to about 75%.

The total amount of water present in the composition is generally from about 5 to about 20% by weight including or comprising water of crystallization of the CN. The use of water in amounts within this range will generally allow the compositions to be fluid enough to be pumped by conventional slurry pumps at elevated formulation or mixing temperatures above the fudge point of the composition (60° or 70° C) but yet to go hard or relatively incompressible upon cooling to temperatures below the fudge point such as room temperature due to the CN reclaiming its water of crystallization upon precipitation. Although at least about 20% CN is required for compositions of the present invention, preferably from about 30 to about 45% CN is employed (excluding water of crystallization).

In addition to S which as indicated is present in amounts of at least about 3% by weight, other solid or liquid fuels or both are employed in amounts sufficient to provide an essentially oxygen-balanced composition. Examples of solid fuels which can be used are finely divided, particulate aluminum, carbonaceous materials such as gilsonite or coal, vegetable grains such as wheat, etc. Liquid fuels may include either water-miscible or immiscible organic liquids. Miscible liquid fuels include alcohols such as methyl alcohol, glycols such as ethylene glycol, amides such as formamide, and analogous nitrogen-containing liquids. These liquids generally act as a solvent for the oxidizer salt and, therefore, can replace water to varying degrees. Immiscible liquid fuels include aliphatic, alicyclic, and/or aromatic saturated or unsaturated liquid hydrocarbons. A particularly preferred immiscible liquid fuel is No. 2 fuel oil. The total amount of fuel employed depends upon the amount of oxidizer salt present as well as the particular type of fuel used but is generally at least about 10% by weight.

The aqueous fluid phase of the composition is preferably rendered viscous by the addition of one or more thickening agents of the type and in the amount commonly employed in the art. Such thickening agents include galactomannin, preferably guar, gums, guar gum of reduced molecular weight as described in U.S. Pat. No. 3,788,909, polyacrylamide and analogous synthetic thickeners, flours and starches. The thickening agent is generally present in amounts from about 0.05 to about 2.5%. However, flours and starches may be employed in much greater amounts, up to about 10%, in which case they also function importantly or even primarily as fuels.

As is well known in the art, gassing agents are preferably employed to lower and control the density of and impart sensitivity to aqueous slurry blasting compositions. The compositions of the present invention preferably employ a small amount, e.g., about 0.01 to about 0.2% or more (most preferably about 0.05%), of such gassing agent in order to obtain a composition density of less than about 1.5 gm/cc. The compositions of the present invention preferably have a density of from about 1.0 to about 1.3 gm/cc. A preferred gassing agent is a nitrite salt such as sodium nitrite. Nitrite salt can be made to decompose chemically in the solution of the composition to produce gas bubbles. Mechanical agitation of the thickened aqueous phase of the composition such as obtained during mixing of the aqueous phase and the solid particulate ingredients will result in the entrainment of fine gas bubbles to produce gassing by mechanical means. Hollow particles such as hollow glass spheres, styrofoam beads and plastic microballoons are also commonly employed to effectuate a gassified slurry composition, particularly when incompressibility is desired under high pressures. Two or more of these common gassing means may be employed simultaneously.

The compositions of the present invention are prepared by first forming a solution of the oxidizer salt and water (and miscible liquid fuel if any) having a fudge point of about 50° C. This solution is prepared and maintained at an elevated temperature of about 60° to 70° C. The solution is preferably pre-thickened by incorporation of part or all of the thickening agent. To this solution is added the remaining ingredients including the particulate S. These remaining ingredients are incorporated into and homogeneously dispersed throughout the solution by a mechanical stirring means as is well known in the art. The resultant explosive composition may then be transferred, e.g., pumped, while still fluid into a desired container.

The present invention can be better understood by reference to a number of examples. Examples A and E in the Table below disclose prior art compositions employing SN/S and paint-grade aluminum as sensitizers. Examples B, C and D employ CN/S as sensitizer in accordance with the present invention. Example C contains paint-grade aluminum as an additional sensitizer. A comparison of examples A and E with B, C and D clearly shows that CN/S is a significantly better sensitizer than the SN/S combination. For example, the SN/S compositions have critical diameters at 5° C of 2.5 inches and 3 inches, respectively, whereas the CN/S compositions, even without paint-grade aluminum sensitization, have critical diameters of 2 inches, less than or equal to 1.5 inches and 1.5 inches, respectively.

This difference in critical diameter is commercially important because packaged products are preferably limited, for reliability of detonation purposes, to diameters that are twice the critical diameter of the composition. Thus Example E generally would not be packaged in a diameter less than 6 inches whereas Examples C and D could be readily packaged in 3 inches diameters. In fact, Example C could most likely be packaged in even smaller diameters than 3 inches since its critical diameter is less than or equal to 1.5 inches. Thus the CN/S combination provides a composition which is significantly more versatile in size as a packaged product.

The CN/S combination of the present invention is found to provide sensitization roughly equivalent to the use of about 1% high quality paint-grade aluminum. Thus a significantly more economical explosive can be provided by employing CN/S instead of or as a partial replacement of paint-grade aluminum. The sensitizing effect of the CN/S combination is readily apparent from a comparison of Examples D and F. These examples are identical in all important respects except that F contains no S. In D, the CN/S sensitization provided a critical diameter at 5° C of 1.5 inches whereas in F, without CN/S sensitization, the critical diameter at 5° C was 5 inches.

The fact that CN/S sensitized compositions are more independent of temperature with regard to sensitivity than SN/S sensitized compositions is readily apparent from a comparison of Example G with H. Example G, CN/S sensitized, has a critical diameter of less than or equal to 1.5 inches at 5° C but is non-cap-sensitive at 20° C, requiring an 8 gm 50/50 pentolite booster for detonation. Example H, SN/S sensitized, has essentially the same sensitivity as G at 20° C, also requiring an 8 gm booster for detonation; however, H is significantly less sensitive at 5° C, having a critical diameter of 2.5 inches, and thus loses its sensitivity more than G does with a decreasing temperature.

The fact that CN/S sensitized compositions can readily be formulated to remain non-cap-sensitive at 20° C is apparent from Examples G and I. At 20° C, both of these examples required an 8 gm 50/50 pentolite minimum booster for detonation. Thus these examples would not detonate at 20° C with a standard No. 8 cap. This high-temperature non-cap-sensitivity was observed even though Example G contained 1% paint aluminum as additional sensitizer and Example I, although containing no paint grade aluminum, contained CN and S in about maximum practicable sensitizing proportions.

Examples J and K contain only 3% S and only about 24% and 16%, respectively, CN (excluding water of crystallization). Although J contains relatively low amounts of CN and S and is clearly less sensitive than, for example, D which contains more optimum amounts of CN and S, it still has sufficient CN/S sensitization to detonate effectively in a 4-inch diameter charge at 5° C. It is significant that K, containing only 16% CN which is less than the practicably required 20% minimum, was not sensitive enough to detonate in even a 6-inch diameter charge at 5° C.

All of the above examples containing CN/S sensitization were found to have good stability and water resistance, to be fluid and pumpable when initially formulated and to be hard and relatively incompressible (except K) upon cooling to temperatures below their respective fudge points.

The compositions of the present invention can be formulated and immediately placed into a borehole by means of a pump truck or other apparatus well known in the art. Due to their good water-resistency, they do not require protective packaging and may be placed directly into water-containing boreholes. Normally, such boreholes would be of diameters of at least 3 inches and usually 6 inches or greater.

For use in small diameters such as 3 inches or less, the compositions would preferably be packaged in cylindrical, stick-like form. A common packaging material is polyethylene. Packaging means or apparatus are known in the art. In packaged form, the compositions can be used much the same as conventional dynamite sticks. Because the compositions are water-resistant, no burdensome precautions need be taken to prevent rupturing of the package in water-present environments. Due to their inherent high sensitivity and their ability to be further sensitized by a relatively small amount of paint-grade aluminum, the compositions can be used in a wide variety of diameters.

As is well known in the art, compositions of the present invention can be formulated to have a variety of physical properties as desired. For example, the fluidity of the compositions can be varied greatly, for instance, by adjusting the relative proportions of thickener, cross-linker and liquid solvent. Although a preferred form is the hard, essentially incompressible and thus relatively pressure-independent form, compositions of a more fluid nature will detonate satisfactorily where high pressures are not encountered.

Although the present invention has been described with referene to illustrative examples and preferred embodiments, various modifications will be apparent to those skilled in the art and any such modifications are intended to be within the scope of the invention as set forth in the appended claims.

TABLE

| Composition Ingredients (% by weight of total composition) | A | B | C | D | E | F | G | H | I | J | K |
|---|---|---|---|---|---|---|---|---|---|---|---|
| Solution containing: | | | | | | | | | | | |
| AN | 42.0 | 37.7 | 37.7 | 38.8 | 37.9 | 38.8 | 37.7 | 42.0 | 38.0 | 46.5 | 55.8 |
| NHCN[1] | — | 45.4 | 45.4 | 46.7 | — | 46.7 | 45.4 | — | 45.8 | 30.0 | 20.0 |
| SN | 13.6 | — | — | — | 14.0 | — | — | 13.6 | — | — | — |
| $.I_2O$ (added) | 14.6 | 5.2 | 5.2 | 5.4 | 12.4 | 5.4 | 5.2 | 14.6 | 5.2 | 13.4 | 15.9 |
| Thickening agent (guar gum) | 0.2 | 0.58[3] | 0.58[3] | 0.6[3] | 0.2 | 0.6[3] | 0.58[3] | 0.2 | 0.6[3] | 0.57[3] | 0.57[3] |
| Thiourea | 0.08 | 0.2 | 0.2 | 0.2 | 0.08 | 0.2 | 0.2 | 0.08 | 0.1 | 0.1 | 0.1 |
| Added to solution: | | | | | | | | | | | |
| Thickening agent | 0.45[2] | — | — | — | — | — | — | — | — | — | — |
| S | 5.3 | 6.3 | 6.3 | 6.6 | 7.1 | — | 6.3 | 6.0 | 6.7 | 3 | 3 |
| Atomized aluminum | 2.0 | 3.0 | 2.0 | — | — | — | — | — | — | — | — |
| Paint-grade aluminum | 1.0 | — | 1.0 | — | 0.5 | — | 1.0 | 1.0 | — | — | — |
| Gilsonite | 6.0 | 5.4 | 5.4 | 4.0 | 6.6 | 8.0 | 4.5 | 4.7 | 5.4 | 6.0 | 5.5 |
| Gassing agent (1 sodium nitrite/4 $H_2O$) | 0.15 | 0.3 | 0.2 | 0.3 | 0.1 | 0.3 | 0.2 | 0.3 | 0.2 | 0.2 | 0.2 |
| Cross-linking agent | — | 0.2[4] | 0.2[4] | 0.2[4] | 0.15[5] | 0.2[4] | 0.2[4] | 0.2[4] | 0.2[4] | 0.2[4] | 0.2[4] |
| Prilled SN | 14.7 | — | — | — | 21.2 | — | — | 17.7 | — | — | — |
| Styrofoam beads | — | — | — | — | 0.5 | — | — | — | — | — | — |
| Properties: | | | | | | | | | | | |
| Density at 5° C | — | 1.08 | 0.97 | 1.03 | 1.01 | — | 1.1 | 1.04 | 1.1 | 1.06 | 1.07 |
| Density at 20° C | 1.13 | — | — | — | — | 1.05 | 1.08 | 1.03 | — | — | — |
| Critical diameter at 5° C (inches) | 2.5 | 2.0 | ≤1.5 | 1.5 | 3.0 | 5.0 | ≤1.5 | 2.5 | 2.5 | 4 | F6 |
| Critical diameter at 20° C (inches) | — | — | — | — | — | 4.0 | — | — | — | — | — |
| Minimum booster at 5° C | — | — | — | — | — | — | — | — | 40 gm | — | — |
| Minimum booster at 20° C | — | — | — | — | — | — | 8 gm | 8 gm | 8 gm | — | — |
| Detonation velocity at 5° C (km/sec) | — | — | — | — | — | — | 2.7 | 2.0 | — | 3.5 | — |

[1]Norsk Hydro fertilizer grade CN of the following approximate formulation (by weight): 6% AN, 79%CN, 15% $H_2O$
[2]General Mills "EX-23" biopolymer gum
[3]Guar gum derivative of reduced molecular weight of about 115,000
[4]Aqueous solution including about 13% sodium dichromate
[5]Aqueous solution including about 50% sodium dichromate

What is claimed is:

1. A blasting composition comprising inorganic oxidizer salt which is partially or completely dissolved in a liquid fluid phase and which includes calcium nitrate in an amount of at least about 20% by weight based upon the total composition; solid or liquid fuel or both; thickener; and at least about 3% by weight sulfur, which functions as a sensitizer in combination with the calcium nitrate.

2. A composition as defined by claim 1 wherein the sulfur is present in amount sufficient to provide a calcium nitrate:sulfur ratio of about 5.3:1.

3. A composition as defined by claim 1 wherein the inorganic oxidizer salt comprises ammonium nitrate and calcium nitrate.

4. A composition as defined by claim 3 wherein the composition comprises from about 5 to about 7% sulfur, from about 35 to about 45% calcium nitrate and from about 5 to about 20% total water.

5. In an aqueous blasting composition comprising inorganic oxidizer salt, partially or completely dissolved in an aqueous fluid phase; solid or liquid fuel or both and thickener; the improvement comprising, as a sensitizer, the combination of at least about 20% calcium nitrate as part or all of the oxidizer salt and at least about 3% sulfur.

6. A composition, as defined by claim 5 wherein at least part of the thickener is cross-linkable and the composition contains a minor amount of a cross-linking agent.

7. A composition as defined by claim 5 wherein the composition is gassified by the use of a minor amount of a gassing agent.

8. A composition as defined by claim 5 wherein at least part of the thickening agent comprises a guar gum or one of its derivatives.

9. A composition is defined by claim 8 wherein the composition contains a minor amount of paint-grade aluminum as an additional sensitizer.

10. A composition as defined by claim 5 which as good low temperature sensitivity but which is not cap-sensitive at 20° C.

11. A hard, relatively incompressible aqueous blasting composition comprising from about 50 to about 80% by weight inorganic oxidizer salt of which at least 20% of the total composition is calcium nitrate, solid or liquid fuel or both, thickener, from about 5 to about 20% total water and at least about 3% sulfur to form a composition that is sensitized by the combination of calcium nitrate and sulfur and that is fluid enough to be pumpable when initially formulated at an elevated temperature above the fudge point of the composition but that becomes hard upon cooling to a temperature below the fudge point.

12. A composition as defined by claim 10 which has good low-temperature sensitivity below the fudge point.

13. A method of sensitizing an aqueous blasting composition, which composition comprises inorganic oxidizer salt, partially or completely dissolved in an aqueous fluid phase, solid or liquid fuel or both and thickener, comprising incorporating into the composition, as a sensitizer, at least about 20% calcium nitrate as part or all of the oxidizer salt and at least about 3% sulfur.

14. A method as recited in claim 13 wherein the composition is formulated by (a) first forming an aqueous solution of part or all of the inorganic oxidizer salt including the calcium nitrate, which solution may be prethickened by the thickener as desired, (b) adding the remaining ingredients including the sulfur and (c) mixing the remaining ingredients into and uniformly throughout the solution to form a homogeneous composition.

* * * * *